United States Patent [19]

Stelma

[11] 4,181,333

[45] Jan. 1, 1980

[54] SASH LOCK

[75] Inventor: Gerard N. Stelma, Grand Rapids, Mich.

[73] Assignee: Keeler Corporation, Grand Rapids, Mich.

[21] Appl. No.: 892,285

[22] Filed: Mar. 31, 1978

[51] Int. Cl.[2] ..... E05C 5/00; E05C 9/14

[52] U.S. Cl. ..... 292/66; 292/113; 292/DIG. 20; 292/DIG. 35

[58] Field of Search ..... 292/66, 97, 71, 223, 292/DIG. 20, DIG. 35, DIG. 47, DIG. 49, 63, 64, 111, 113, 247

[56] References Cited

U.S. PATENT DOCUMENTS

| | | | |
|---|---|---|---|
| 1,899,466 | 2/1933 | Kistner | 292/DIG. 20 |
| 2,078,572 | 4/1937 | Jacob | 292/DIG. 20 |
| 3,109,675 | 11/1963 | Anderson | 292/DIG. 20 |
| 3,706,467 | 12/1972 | Martin | 292/DIG. 47 |
| 3,998,481 | 12/1976 | Anthone | 292/66 X |

*Primary Examiner*—J. Franklin Foss

*Attorney, Agent, or Firm*—Price, Heneveld, Huizenga & Cooper

[57] ABSTRACT

This specification discloses a sash lock wherein a catch is mounted on one window sash and a base supporting a latch is mounted on another window sash. The latch has a handle portion and a hook portion. In a locked position, both of the portions of the latch engage the catch, the hook portion from the top and the handle portion through an opening in the catch. The sash lock includes springs to bias the latch into a noninterfering position.

9 Claims, 6 Drawing Figures

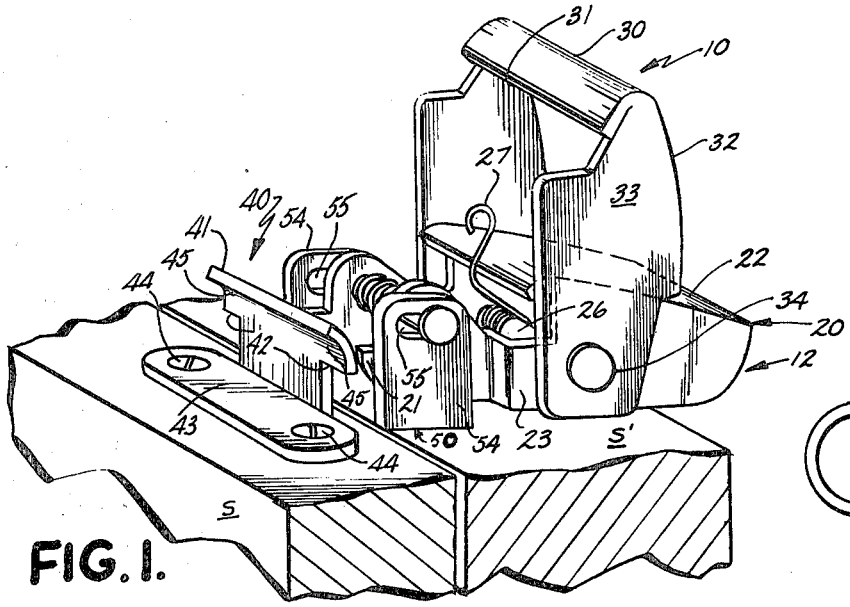
FIG. 1.
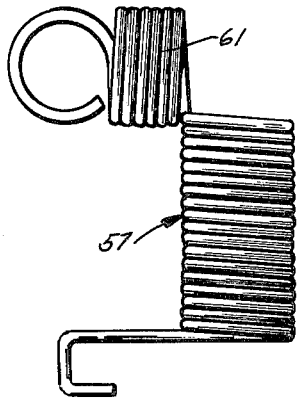
FIG. 6.
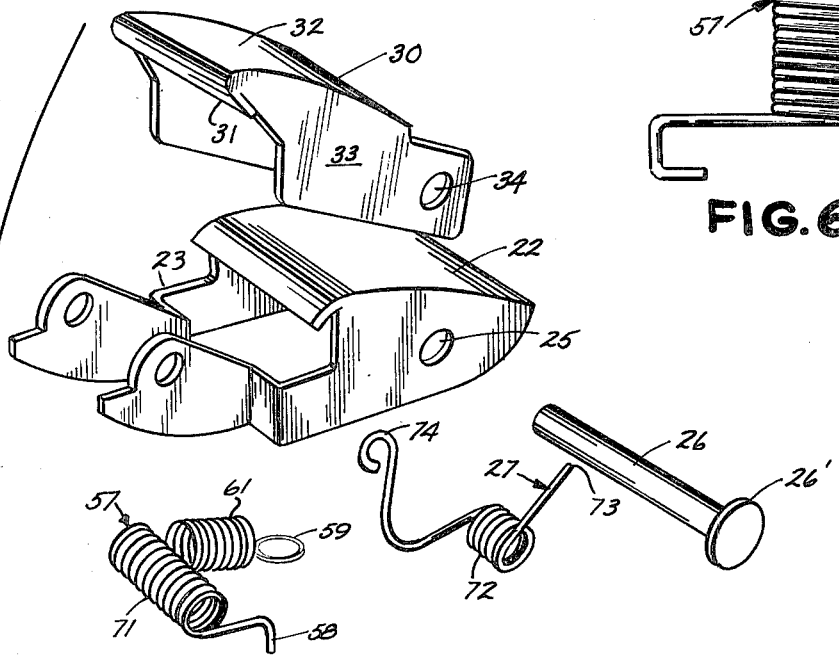
FIG. 5.
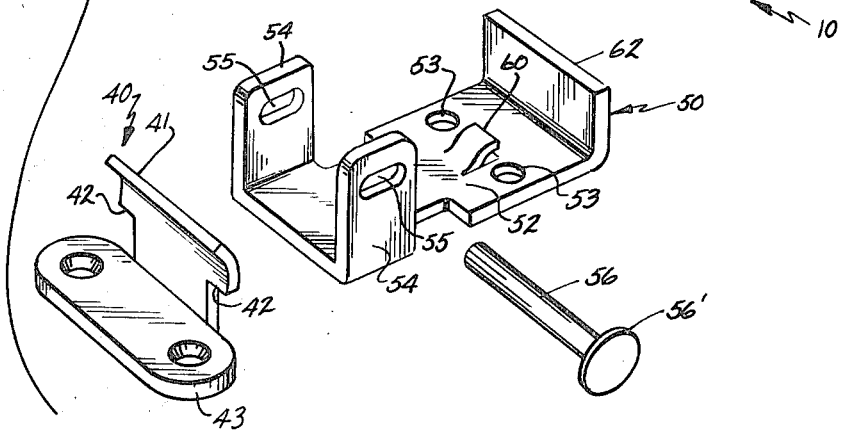

SASH LOCK

BACKGROUND OF THE INVENTION (1) Field of the Invention

This invention relates to a lock for two components; and, in particular, a lock for use with double hung windows having adjacent upper and lower sashes.

(2) Prior Art

The prior art teaches the use of sash locks having two interengaging hooks, one hook being on one sash and the other hook being on another sash. The hooks can interengage each other in a manner similar to curling the fingers of both hands and hooking the tips of the fingers of one hand into the recess formed by the fingers of the other hand. However, as with the fingers, when opposing forces are applied, there is a tendency to slip. In any case, the material needed to maintain the curl of the hooks should be strong enough to resist any applied force. As a result, either the material requirements for the hooks are undesirably rigid, and therefore expensive, or the sash lock fails under an applied force. Further, the engagement of the two interengaging hooks typically is accomplished by pivoting one of the hooks about a point so the hook snaps into a retained position. That is, much as fastening a buckle on a boot, the final position is not as tight as an intermediate position when a peak effort is required to get the catch into the retaining position. As a result, not only must the material of the latch and catch be sufficiently strong to lock, but there must be resilience sufficient to provide a retaining force in the locked position and with enough give to get past the point of peak effort. Not only are there two conflicting requirements of strength and resilience, but the lock is susceptible to failure by the slipping of the interengaging hooks.

The prior art also teaches a more positive bolt-like locking action which can improve the securing of the two window sashes. However, the typical problem is that there must be essentially perfect alignment between the two window units for the bolt to seat properly. Further, numerous of the prior art locking devices, and in particular bolts, can be undesirably inconvenient when unintentionally left in a position of interference with movement of the window. If the window is moved with some force, such force as might be used with a stuck window, the bolt and/or the window may be damaged. These are some of the problems this invention overcomes.

SUMMARY OF THE INVENTION

This invention teaches a sash lock which provides the strength of a bolt-like action and yet does not initially require perfect alignment. The sash lock has a latch on one window component having two pieces mounted on the window component, each of which two pieces engage a latch component on another window piece.

This unique apparatus provides both an aligning action for the lock and a positive bolt-like locking action by having a two component latch, both of which components individually engage a catch mounted on an adjacent window sash. A first latch component provides an aligning action as well as a locking action, first drawing the catch toward the latch and then retaining a grip on the catch. A second latch component provides for a second positive locking action and for double pivotal movement of the first latch component to better engage the catch when there is a misalignment between the catch and the latch.

BRIEF DESCRIPTION OF THE DRAWINGS

FIG. 1 is a front perspective view of a sash lock in accordance with an embodiment of this invention in an unlocked condition and biased to a noninterference position;

FIG. 5 is an exploded perspective view of the sash lock of FIG. 1; and

FIG. 6 is a plan view of a spring for biasing a handle portion of the latch with respect to the base of the sash lock including a tension biasing portion and a torsional biasing portion.

DETAILED DESCRIPTION OF THE INVENTION

Figure 4:
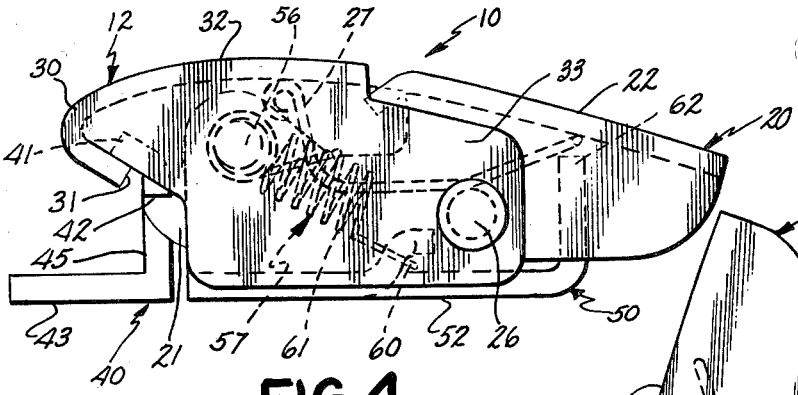
FIG. 4 is a side elevation view similar to FIG. 3 with the sash lock in a locked condition.

Referring to FIG. 1, a sash lock 10 includes a catch component 40 mounted on one window sash S and a base 50 mounted on another window sash S′ supporting a two-piece latch 12 wherein each of the pieces, a handle 20 and a hook 30, engage catch 40. Handle 20 is pivotally connected to base 50 and hook 30 is pivotally connected to handle 20 so that a curved lip 31 on hook 30 can engage a curved lip 41 on catch 40 even when catch 40 is out of alignment with base 40. The double pivoting permits hook 30 to draw up catch 40 into alignment and then have protrusions 21 from handle 20 extend to engage notches in catch 40, providing a secure bolt-like locking action. Thus, sash lock 10 provides the double locking of lips 31 and 41 and protrusions 21 and edges 42.

The pivotal connection between base 50 and handle 20 has an elongated slot 55 to facilitate, first, the engagement of catch 40 by a hook 30 when there is some misalignment and, second, to facilitate insertion of protrusions 21 under edges 42. The purpose of the slotted arrangement is to provide lateral movement, so that the portion 61 of spring 57 can bias the assembly back from the edge of the sash, to prevent its being struck by the upper sash during movement of either sash.

As shown in FIG. 1, catch 40 has a generally horizontal mounting flange 43 which is generally rectangular in shape and has openings therethrough for passing screws 44 for mounting catch 40 on a window wash S. A wall 45 extends upwardly from the forward edge of mounting flange 43 and has a backwardly extending lip 41 at its top edge. Edges 42 are positioned below lip 41 and extensions of wall 45.

Figure 3:
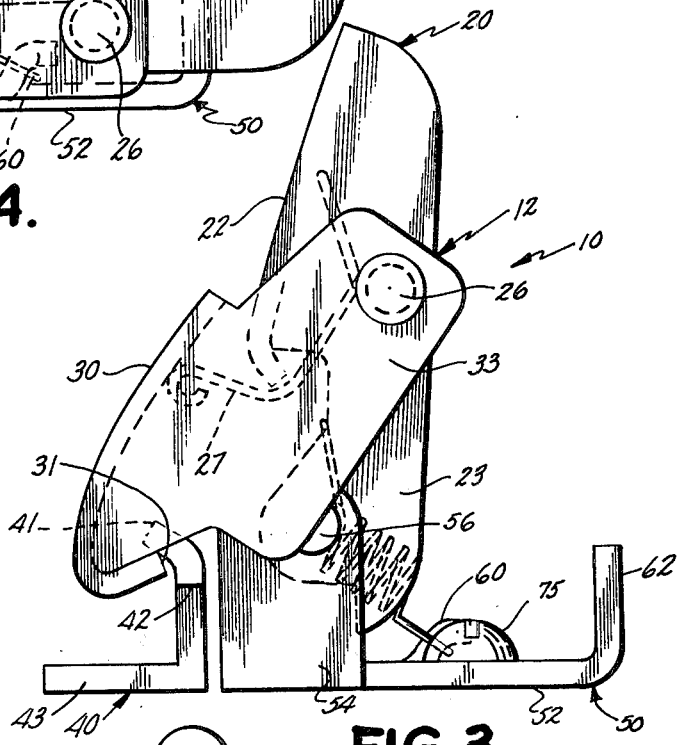
FIG. 3 is a side elevation view of the lock of FIG. 2 with the latch pivoted so that the latch engages the catch.

Referring in particular to FIGS. 1, 3 and 5, base 50 includes a generally horizontal plate 52 having a pair of openings 53 therethrough for mounting base 50 on a window sash S′ by means of screws 75 (FIG. 3). A pair of side supports 54 extend upwardly from either side of plate 52 at the end of base 50 adjacent catch 40. Each of side supports 54 has an opening 55 therethrough for passing a pivot pin 56 to rotationally couple handle 20 to base 50. Further, pivot pin 56 supports a spring 57 which has a coil or coiled torsional portion 72 wound around pivot pin 56 and a first end 58 for hooking around a portion of handle 20 and a second end 59 for attaching to a prong 60 extending upward from plate 52.

Torsional portion 71 acts to keep handle 20 rotationally biased toward base 50. A coiled tension portion 61 on spring 57 between end 59 and a pivot pin 56 acts to bias pivot pin 56 within slots 55 away from catch 40. A rear wall 62 extends generally vertically upward from the rear edge of plate 52 and positively limits downward travel of handle 20 when in a locked condition.

Figure 2:
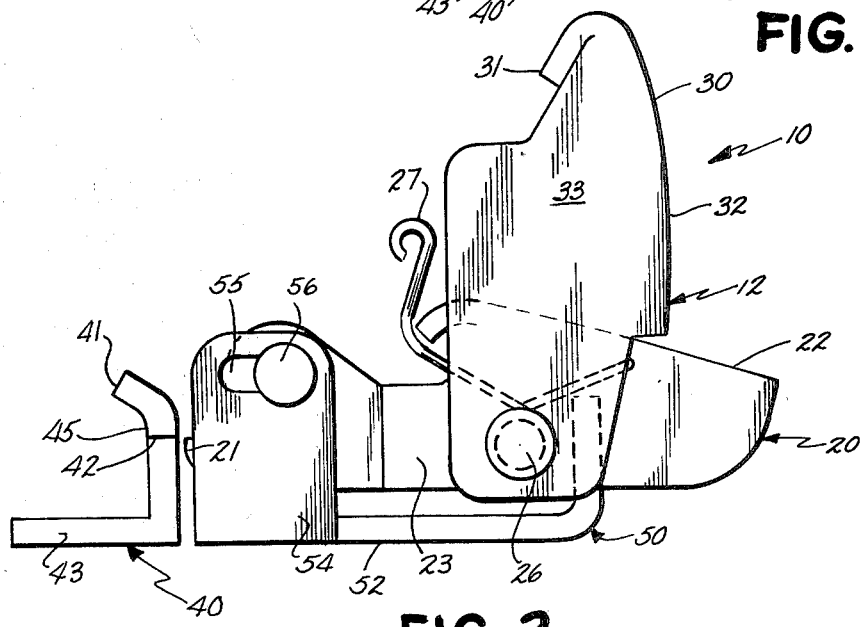
FIG. 2 is a side elevation view of the lock of FIG. 1.

Handle 20 includes a body 22 with a pair of parallel spaced forwardly extending arms 23 having at the end thereof a pair of openings 24 for aligning with slot 55 and passing pivot pin 56 (FIG. 5). Protrusion 21 extends from the end of each of arms 23 and is stepped inwardly of arm 23 and then extends toward catch 40 for engaging edges 42. The rear portion of each of arms 23 also has an opening 25 for passing a pivot pin 26 which pivotally connects hook 30 to handle 20. A spring 27 has a torsional section 72 coiled around pivot pin 26 and one end 73 engaging the bottom portion of body 22 and the other end 74 engaging the bottom portion of hook 30 thereby pivotally biasing hook 30 toward handle 20 and away from catch 40. As a result of the combined biasing action of springs 57 and 27, latch 12 remains in a noninterference position with respect to catch 40 when sash lock 10 is in an unlocked condition (FIG. 2).

Hook 30 includes a generally curved top surface 32, the forward portion of which terminates in a curved lip 31 for engaging lip 41 of catch 40. A pair of generally planar sidewalls 33 extend downward from each side of top surface 32. A rear portion of each of sidewalls 33 has an opening 34 therethrough for passing pivot pin 26 thereby pivotally connecting hook 30 to handle 20. Pivot pins 26 and 56 each have end caps 26′ and 56°, respectively, for longitudinally securing the pin. Advantageously, washers are placed upon pivot pins 56 and 26 between adjacent members of sash lock 10 for easy movement of the components of sash lock 10. The components of sash lock 10 such as catch 40, base 50, handle 20 and hook 30 are all advantageously formed from sheet metal material. Thus fabrication can be relatively inexpensive and simple. For example, generally speaking, handle 20 and catch 30 each include a flat or slightly curved portion which have bent edges to form side arms or the engaging lips.

OPERATION

To install sash lock 10, catch 40 is secured to window sash S by screws 44 through mounting flange 43. Base 50 is aligned with catch 40 and secured by screws 75 extending through openings 53 into window sash S′. The spacing between catch 40 and base 50 is sufficiently close so that protrusions 21 of latch 12 can extend under edges 42. In an unlocked configuration, end 58 of spring 57 biases body 22 of handle 20 toward base 50. This is a result of the torsional action of coil 71 of spring 57 around pivot pin 56. Coiled tension portion 61 of spring 57 draws pivot pin 56 along slot 51 away from catch 40. Hook 30 is pivoted by spring 27 back away from catch 40 so that lip 31 is well clear of catch 40.

To put sash lock 10 in a locked condition, body 22 of handle 20 is raised so that lip 41 of catch 40 is engaged by lip 31 of hook 30. Lip 41 can be somewhat misaligned downwardly because handle 20 can pivot around pivot pin 56 to position lip 31 of hook 30 below pivot pin 56. Further, the pivoting of hook 30 about pivot pin 26 permits lip 31 to be drawn sufficiently toward lip 41 so that the two can interengage.

Pivoting body 22 of handle 20 downwardly toward rear wall 62 of base 50 pulls catch 40 upward if it is misaligned and secured engages lips 31 and 41. The engagement of hook 30 causes a force on handle 20 toward catch 40 so that pivot pin 56 slides forward in slot 55 toward catch 40 and protrusion 21 easily enters opening 42 of catch 40.

In a locked condition, sash lock 10 has an engagement at two points, one point between lips 31 and 41 and another point between protrusions 21 and edges 42. Not only is there double security, but there is also an action which tends to reduce any misalignment before a positive bolting action takes place.

Various modifications to the preferred embodiment will, no doubt, occur to those skilled in the various arts to which this invention pertains. For example, the particular size and shape of the springs and of the mounting components may be varied from that disclosed herein. These and all other variations which basically rely on the teachings through which this disclosure has advanced the art are properly considered within the scope of this invention as defined by the appended claims.

The embodiments of the invention in which an exclusive property or privilege is claimed are defined as follows:

1. A sash lock for two relatively movable components, such as double hung window, comprising:
   - a catch means on a first of the two relatively movable components for securing said sash lock to said first movable component;
   - a base means on a second of the two relatively movable components for securing said sash lock to said second movable component;
   - a latch mounted on said base means for engaging said catch means, said latch including an upper portion and a lower portion, each of said upper and lower portions engaging said catch means thereby securing the two relatively movable components to each other, said upper and lower portions being pivotally connected to each other and said lower portion being pivotally connected to said base means.

2. A sash lock as recited in claim 1 further comprising a first spring means for pivotally biasing said upper portion and said lower portion toward each other and a second spring means for pivotally biasing said lower portion away from said catch means thereby positioning said latch in a non-interfering position when said sash lock is in an unlocked condition.

3. A sash lock as recited in claim 1 wherein one of said base means and said lower portion have an elongated slot at the pivotal connection between said base means and said lower portion thereby improving engagement of said catch means by said upper portion when said catch means is out of alignment with said base means and facilitating movement of said lower portion into engagement with said catch means.

4. A sash lock for two relatively movable components, such as a double hung window, comprising:
   - a catch means on a first of the two relatively movable components for securing said sash lock to said first movable component, said catch means including a lip with means for mounting said lip in spaced relationship from the surface of said movable component on which it is mounted, said lip having upper and lower edges spaced from said surface;
   - a base means on a second of the two relatively movable components for securing said sash lock to said second movable component;
   - a latch mounted on said base means for engaging said catch means, said latch including an upper portion and a lower portion, in locked position one of said upper and lower portions extending over said upper edge of said lip and the other of said portions extending under said lower edge of said lip and each of said upper and lower portions engaging said catch means thereby securing the two relatively movable components to each other; and means responsive to the movement of one of such portions to a locked position for causing the portions to clamp like a jaw about said upper and lower edges of said lip.

5. A sash lock for two relatively movable components, such as a double hung window, comprising:

a catch attached to a first of the two relatively movable components, said catch including an upwardly extending upper lip and a recess under said lip;

a base attached to a second of the two relatively movable components having a pair of spaced bracket members extending upwardly, each of said bracket members having an elongated, generally horizontal slot extending therethrough; and a latch including a lower portion, an upper portion, a first pivot pin extending through said horizontal slots and through an opening in said lower portion thereby pivotally connecting said base and said lower portion, a second pivot pin spaced from said first pivot pin extending through openings in said upper and lower portions thereby pivotally connecting said upper and lower portions, a first spring means coupled between said lower portion and said base for biasing said lower portion and said base toward one another about said first pivot pin, a second spring means coupled between said lower and upper portions for biasing said upper and lower portions toward one another about said second pivot pin, said upper portion having a hooked end for engaging said lip of said catch, said lower portion having a projection for extending into said recess of said catch as said lower portion is rotated so that said first pivot pin slides along said elongated slots of said base toward said catch and securely couples said latch to said catch.

6. A sash lock as recited in claim 5 wherein said first spring means further includes a tension means for biasing said latch along said horizontal slot in a direction away from said catch thereby helping to position said latch and said catch in a non-interfering position.

7. A sash lock as recited in claim 5 wherein:

said first spring means has one end coupled to said base, the other end coupled to said lower portion and an intermediate portion wound on said first pivot pin thereby providing a torsional biasing between said base and said lower portion, and a coil section between said first pivot pin and said base for applying a biasing force on said first pivot pin within said elongated slot thus tending to move said lower portion away from said catch; and said second spring has a central torsional portion wound around said second pivot pin and ends for engaging said upper and lower portions for biasing said upper and lower portions torward each other and away from a locked configuration.

8. A sash lock as recited in claim 5 wherein said base includes an upwardly extending wall to the rear of said spaced brackets, said wall limiting rotation of said lower portion relative to said base so that said sash lock is in a locked position.

9. A sash lock as recited in claim 7 wherein said base includes a protrusion extending outwardly for attaching to one end of said first spring means so that said latch is biased in the direction of said protrusion.

* * * * *